US007425364B2

(12) United States Patent
Harwood et al.

(10) Patent No.: US 7,425,364 B2
(45) Date of Patent: Sep. 16, 2008

(54) ANTISTATIC SPIRAL FABRIC

(75) Inventors: William Joseph Harwood, Waycross, GA (US); Gilbert Ross, Waycross, GA (US)

(73) Assignee: Voith Fabric Patent GmbH, Heindenheim (DE)

( * ) Notice: Subject to any disclaimer, the term of this patent is extended or adjusted under 35 U.S.C. 154(b) by 174 days.

(21) Appl. No.: 11/173,028

(22) Filed: Jul. 1, 2005

(65) Prior Publication Data

US 2007/0003729 A1 Jan. 4, 2007

(51) Int. Cl.
*D21F 7/08* (2006.01)

(52) U.S. Cl. ..... 428/222; 139/383 A; 198/851; 442/337

(58) Field of Classification Search ..... 428/222; 139/383 A; 198/851; 442/337
See application file for complete search history.

(56) References Cited

U.S. PATENT DOCUMENTS

| | | | | |
|---|---|---|---|---|
| 4,061,811 | A * | 12/1977 | Takase et al. | 428/95 |
| 4,423,543 | A | 1/1984 | Leuvelink | 29/433 |
| 5,534,333 | A | 7/1996 | Keller et al. | 428/222 |

FOREIGN PATENT DOCUMENTS

| | | |
|---|---|---|
| GB | 2 346 387 | 8/2000 |
| WO | WO2005/059243 | 6/2005 |

* cited by examiner

*Primary Examiner*—Alexander Thomas
(74) *Attorney, Agent, or Firm*—Taylor & Aust, P.C.

(57) ABSTRACT

In a spiral link fabric having a plurality of helical coils connected along a coiled perimeter to form a plurality of hinges, each hinge is formed using one of a plurality of connecting rods. The result is a spiral link fabric having a plurality of open channels between each of the plurality of hinges. At least one antistatic stuffer yarn made of polyamide impregnated with carbon is place in at least one of the plurality of open channels to dissipate any electrostatic discharge.

15 Claims, 3 Drawing Sheets

PRIOR ART

ANTISTATIC SPIRAL FABRIC

CROSS-REFERENCE TO RELATED APPLICATIONS

Not applicable

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The invention relates to a fabric having an antistatic stuffer used in the manufacture of non-woven textiles.

2. Description of Background

Non-woven textiles are broadly defined as sheet or web structures bonded together by entangling of the fibers mechanically, thermally or chemically. Non-woven textiles are not made by weaving or knitting. Thus, non-woven fabrics are engineered fabrics that may be a limited life, single-use fabric or a very durable fabric. These fabrics can imitate the appearance, texture and strength of a woven fabric.

During the fabrication of most nonwovens, static electricity can build-up. The result of static electricity build-up is the occasional spontaneous electrostatic discharge, or ESD. An ESD can not only damage the non-woven product in production, but it can also irreparably damage the fabric used in the fabrication of the non-woven product. This can lead to costly replacement of the fabric and down time for the manufacturing apparatus. In the worst case scenario, the machine fabricating the non-woven product can be damaged, or initiation of a fire could result.

One way to avoid ESD is to use an antistatic fabric made with carbon-filled polyamide antistatic yarns and conductive edging. These are generally endless or loop seamed. However, loop seams are weaker than the main body of the fabric, and they can place a seam mark on the finished product. Still further, endless fabrics are difficult and time-consuming to install, and cut warp ends at the seamed area become points of attachment for the non-woven fibers, resulting in "fiber picking."

BRIEF SUMMARY OF THE INVENTION

Accordingly, there is a need for an antistatic fabric that is easy to install, is non-marking, and is non-picking, yet has effective anti-static qualities. The present invention is for a fabric used in products manufactured in the non-woven industry. In the preferred embodiment, the fabric is a spiral stuffed with anti-static yarn. The fabric is preferably a spiral fabric having a plurality of spirals, and each spiral is stuffed with anti-static yarn. In the event of localized damage to the fabric, only removal of the damaged portion of the fabric is required. Additional fabric can be attached if desired or needed.

Additionally, the spiral fabric may contain up to approximately 25%, preferably approximately 15%, contaminant release properties, that is, not a coating. Accordingly, as the spiral wears, the contaminant release properties remain. In this manner, "drips" of molten polymer can be removed easily with a cleaning system, for example, brushes, vacuum, and the like. If the fabric is damaged by the hot molten polymer drips, a section of the spiral can be removed and/or replaced.

The contaminant release is part of the monofilament used to make the spiral, for example, the additive can be PTFE.

A fabric used on the formation of material produced for the non-woven industry has a spiral link fabric, the spiral link fabric having a plurality of helical coils connected along a coiled perimeter to form a plurality of hinges, each hinge formed using one of a plurality of connecting rods, resulting in a spiral link fabric having a plurality of open channels between each of the plurality of hinges; at least one antistatic stuffer yarn, the at least one antistatic stuffer yarn situated in one of the open channels.

Still further, the at least one antistatic stuffer yarn is removably attached to the spiral link fabric.

Additionally, the at least one antistatic stuffer yarn is at least one of a conductive monofilament, a conductive multifilament, a conductive metal, a conductive foam, and any other conductive stuffer that can be placed in one of the open channels. In the preferred embodiment, the antistatic stuffer yarn is a carbon impregnated polyamide.

Still further, at least one permeability control yarn is collocated with the at least one antistatic stuffer yarn in the open channel. In the preferred embodiment, the at least one permeability control yarn is polyester, and is either a monofilament or a multifilament.

Additionally, when the at least one antistatic stuffer yarn is a monofilament, it has a diameter between approximately 0.1 mm to approximately 1.0 mm. When the at least one antistatic stuffer yarn is a multifilament it has a range between approximately 22 dTex and approximately 1500 dTex. Still further, the cross section of the antistatic stuffer is either a round cross section or a profiled cross section.

Still further, a coating can be applied that connects a first longitudinal end of the at least one antistatic stuffer yarn and a first longitudinal end of the helical coils. The coating electrically connects the at least one antistatic stuffer yarn to form a conductive grid, thereby dissipating the ESD. The coating, in the preferred embodiment, is made from carbon particles suspended in latex.

Additionally, when a plurality of the antistatic stuffer yarns is used, these antistatic stuffer yarns are regularly spaced among the open channels in the spiral fabric. In this manner the electrostatic buildup can be collected and dissipated along a larger portion of the fabric. It is also conceived that a plurality of the at least one antistatic stuffer yarns are placed in every open channel, thereby maximizing the collection and dissipation of electrostatic charge buildup.

These and other features and advantages of this invention are described in or are apparent from the following detailed description of the preferred embodiments.

BRIEF DESCRIPTION OF THE DRAWINGS

The preferred embodiments of the present inventions will be described in detail, with reference to the following figures, wherein.

DETAILED DESCRIPTION OF THE INVENTION

Figure 1:
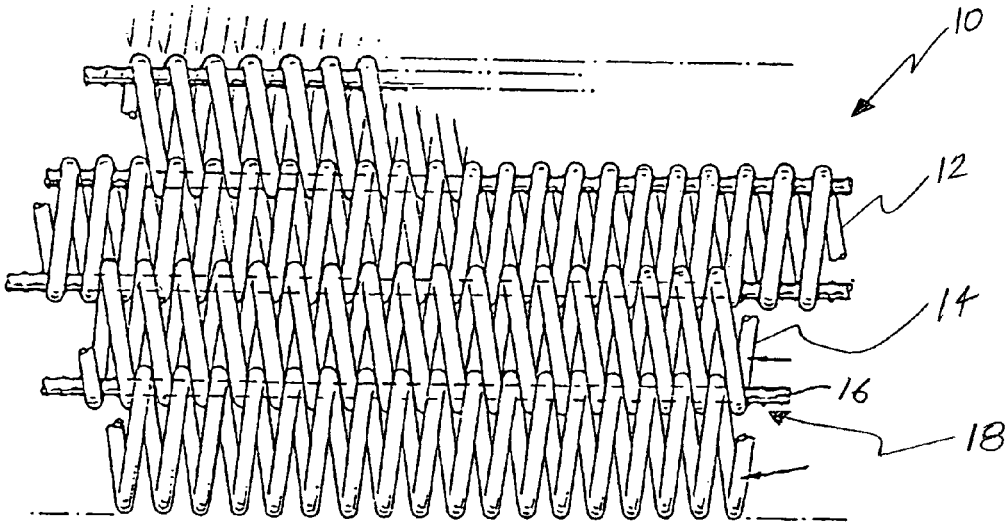
FIG. 1 depicts a plan view of a prior art link fabric.

FIG. 1 depicts a plan view of a prior art link fabric 10. Generally, individual coils 12, 14 are connected by interdigiting adjacent turns of the coils and inserting a connecting rod, or pintel 16 into the interdigited region 18. This prior art is disclosed, for example, in U.S. Pat. No. 4,423,543.

Figure 2:
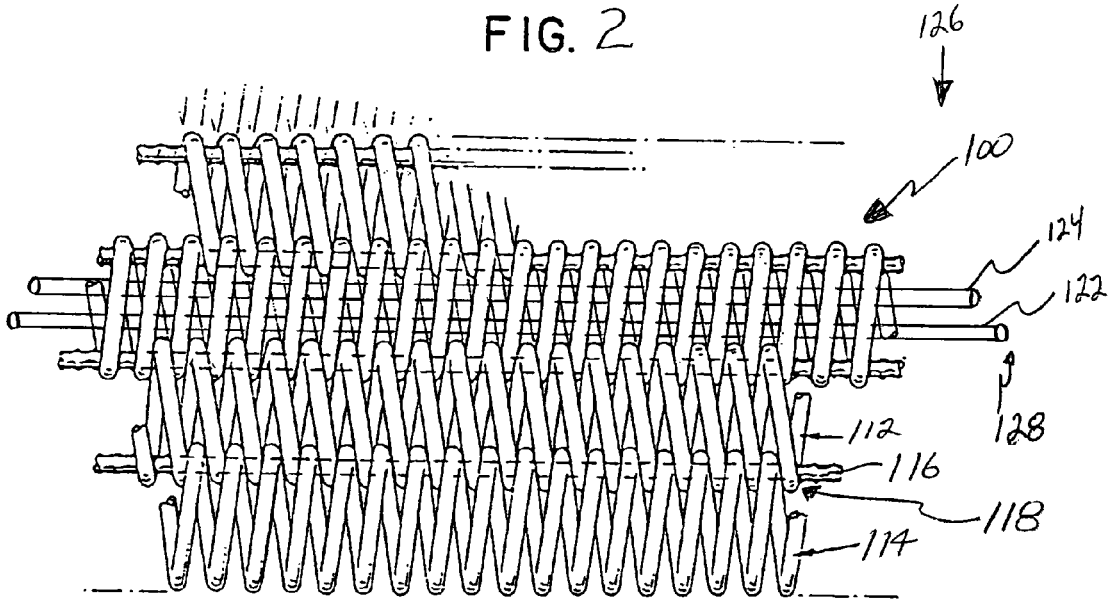
FIG. 2 depicts a plan view of a link fabric according to the present invention.
Figure 3:
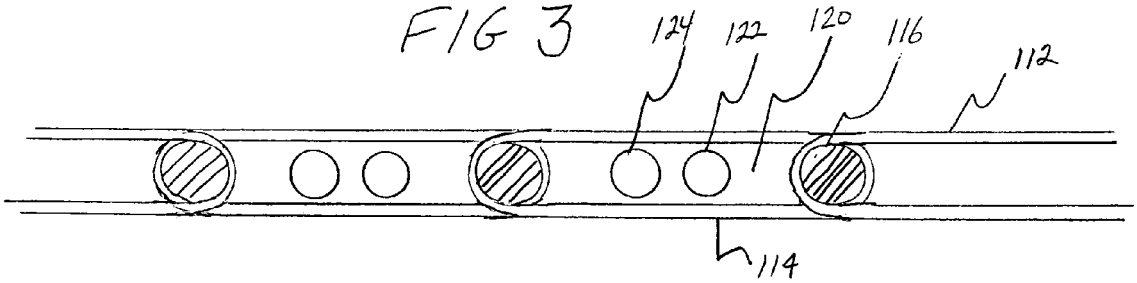
FIG. 3 depicts a partial cross-sectional view the link fabric according to the present invention.

FIG. 2 depicts a plan view of a link fabric 100 according to the present invention. The individual link coils 112, 114 are connected in indigiting adjacent turns of the coils and inserting a connecting rod, or pintel 116 into the indigited region 118. An open channel 120 is thereby created between the connecting rods 116.

The open channel, or region 120 located between the connecting rods 116 is stuffed with at least one antistatic stuffer yarn 122. This at least one antistatic stuffer yarn 122 is removably attached to the spiral link fabric 100. The at least one antistatic stuffer yarn 122 is at least one of a conductive monofilament, a conductive multifilament, a conductive metal, a conductive foam, and any other conductive stuffer that can be placed in one of the open channels. In the preferred embodiment, the antistatic stuffer yarn 122 is a carbon impregnated polyamide.

When the at least one antistatic stuffer yarn 122 is a monofilament, it has a diameter between approximately 0.1 mm to approximately 1.0 mm. When the at least one antistatic stuffer yarn 122 is a multifilament, it has a range between approximately 22 dTex and approximately 1500 dTex. Still further, the cross section of the antistatic stuffer yarn 122 is either a round cross section or a profiled cross section. A profiled cross section is any geometric shape that is not round or circular. For example, a profiled cross section can be oval, square, diamond, and polygonal.

When a plurality of the antistatic stuffer yarns 122 are used, these antistatic stuffer yarns 122 are regularly spaced among the open channels 120 in the spiral fabric 100.

Adjacent to the antistatic stuffing yarn 122 is optionally placed a stuffing, or permeability control yarn 124. Still further, the at least one permeability control yarn 124 is collocated with the at least one antistatic stuffer yarn 122 in the open channel 120. Stated differently, the at least one permeability control yarn 124 can be placed side-by-side with the antistatic stuffer yarn 122, as shown in the figure, or the two yarns 122, 124 can be twisted or otherwise attached to each other. In the preferred embodiment, the at least one permeability control yarn 124 is polyester, and is either a monofilament or a multifilament. The diameter of the permeability control yarn 124 is selected to determine the permeability of the fabric 100.

Still further, a coating or adhesive (not shown) can be applied that connects a first longitudinal end 126 of the at least one antistatic stuffer yarn 122 and a first longitudinal end of the helical coils 128. This coating or adhesive acts as a bus bar, electrically connecting the at least one antistatic stuffer yarn 122 to form a conductive grid, thereby dissipating the ESD. The coating or adhesive can be a heat seal adhesive that bonds the edges of the antistatic stuffer yarn 122 with the first longitudinal edge of the helical coils 128 of the fabric 100. This heat seal adhesive can be, for example, a carbon impregnated adhesive. The coating or adhesive, in the preferred embodiment, is made from carbon particles suspended in latex.

While the present invention has been particularly shown and described with reference to the foregoing preferred embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

What is claimed as new and desired to be protected by Letters Patent of the United States is:

1. A fabric comprising:

a spiral link fabric, the spiral link fabric comprising a plurality of helical coils connected along a coiled perimeter to form a plurality of hinges, each hinge formed using one of a plurality of connecting rods, resulting in a spiral link fabric having a plurality of open channels between each of the plurality of hinges, said spiral link fabric being permeable, each of said plurality of helical coils having a longitudinal end;

a plurality of antistatic stuffer yarns each having a longitudinal end, at least one of said plurality of antistatic stuffer yarns situated in a corresponding one of the plurality of open channels; and a coating connecting said longitudinal ends of said helical coils to corresponding longitudinal ends of said plurality of antistatic stuffer yarns, said coating and said plurality of antistatic stuffer yarns forming an electrically conductive grid.

2. The fabric of claim 1, wherein the at least one antistatic stuffer yarn is removably attached to the spiral link fabric.

3. The fabric of claim 1, wherein the at least one antistatic stuffer yarn is at least one of a conductive monofilament, a conductive multifilament, a conductive metal, a conductive foam, and any other conductive stuffer that can be placed in one of the plurality of open channels.

4. The fabric of claim 1, wherein the antistatic stuffer yarn is a carbon impregnated polyamide.

5. The fabric of claim 1, further comprising at least one permeability control yarn collocated with the at least one antistatic stuffer yarn in the one of the plurality of open channels.

6. The fabric of claim 5, wherein the at least one permeability control yarn is polyester.

7. The fabric of claim 5, wherein the at least one permeability control yarn is one of a monofilament and a multifilament.

8. The fabric of claim 1, wherein the at least one antistatic stuffer yarn is a monofilament having a diameter between approximately 0.1 mm to approximately 1.0 mm.

9. The fabric of claim 1, wherein the at least one antistatic stuffer yarn is a multifilament have a range between approximately 22 dTex and approximately 1500 dTex.

10. The fabric of claim 1, wherein the at least one antistatic stuffer has at least one of a round cross section and a profiled cross section.

11. The fabric of claim 1, wherein the coating comprises carbon particles suspended in latex.

12. The fabric of claim 1, wherein a plurality of the at least one antistatic stuffer yams are regularly spaced among the open channels.

13. The fabric of claim 1, wherein a plurality of the at least one antistatic stuffer yams are places in every open channel.

14. The fabric of claim 1, wherein the fabric is for use in non-woven industry for the formation of a product.

15. The fabric of claim 1, wherein the fabric is for use in the dryer section in the papermaking industry.

* * * * *